United States Patent [19]

Echasseriau et al.

[11] Patent Number: 4,621,250

[45] Date of Patent: Nov. 4, 1986

[54] ROTARY POTENTIOMETER, PARTICULARLY FOR MEASURING ANGULAR POSITION

[75] Inventors: Gilbert Echasseriau; Philippe LeFevre; Patrice Oliveau, all of Toulouse, France

[73] Assignee: Renix Electronique, Toulouse, France

[21] Appl. No.: 703,489

[22] Filed: Feb. 20, 1985

[30] Foreign Application Priority Data

Feb. 28, 1984 [FR] France ..... 84 03006

[51] Int. Cl.[4] ..... H01C 10/30

[52] U.S. Cl. ..... 338/162; 338/170; 338/184; 338/167

[58] Field of Search ..... 338/162, 163, 167, 149, 338/168, 170, 174, 184, 118, 121, 122, 164, 165, 166

[56] References Cited

U.S. PATENT DOCUMENTS 3,350,673 10/1967 Spaude ..... 338/184 X 3,629,777 12/1971 De Long et al. ..... 338/184 X 3,947,800 3/1976 Van Benthuysen et al. ..... 338/163

4,355,293 10/1982 Driscoll ..... 338/184

4,430,634 2/1984 Hufford et al. ..... 338/164

*Primary Examiner*—Clarence L. Albritton

*Assistant Examiner*—M. M. Lateef

*Attorney, Agent, or Firm*—Oblon, Fisher, Spivak, McClelland & Maier

[57] ABSTRACT

A stationary case has a resistive track. An elastic wiper is carried by a rotor mounted to rotate in the case and able, during operation, to rub against the resistive track, and a spring is placed between the stationary case and the rotor to pull the rotor to a rest position. The case provides at least one housing able to receive the wiper without initial stress or deformation in an initial position of introduction of the rotor in the case and to allow the wiper to come in contact with the track during mounting of the rotor in the case by rotation of said rotor between its introduction position and its rest position. Application is to measuring the angular position of the throttle valve of an internal combustion engine.

13 Claims, 7 Drawing Figures

FIG.2
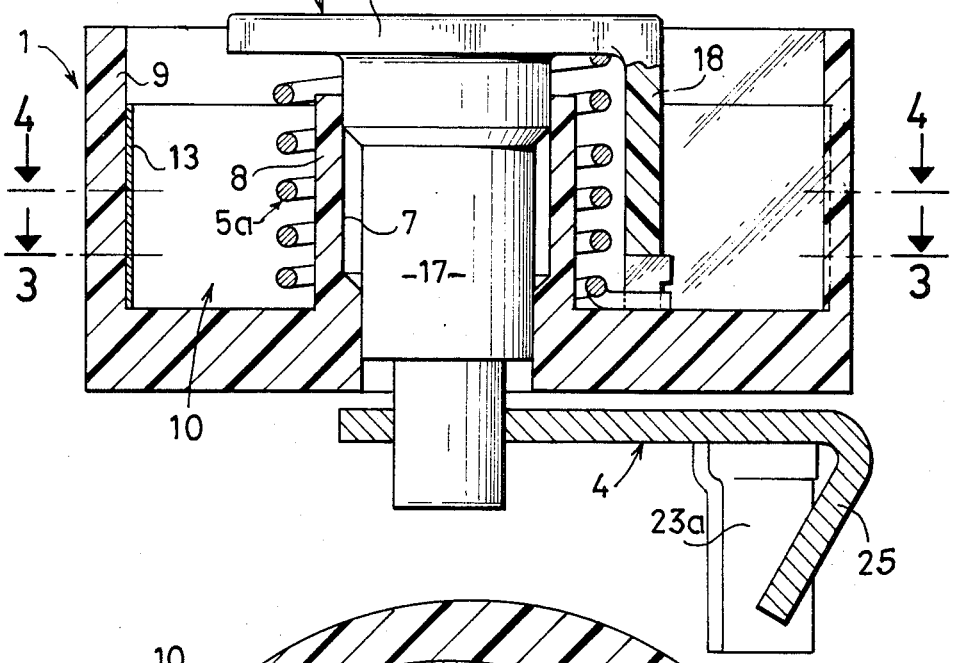
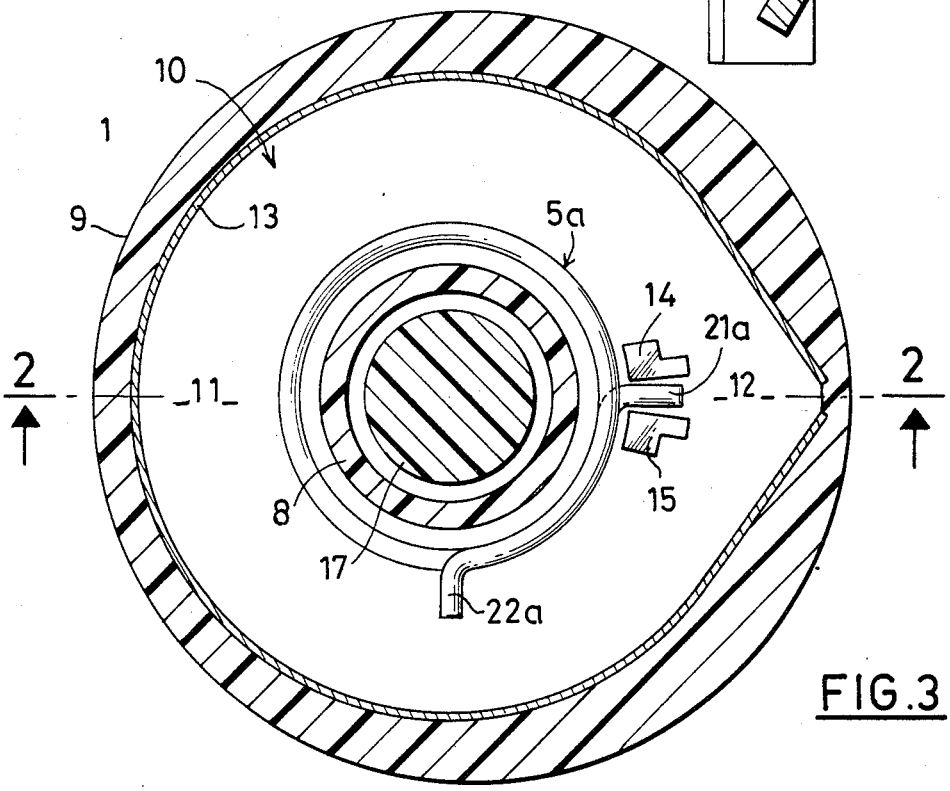
FIG.3

ROTARY POTENTIOMETER, PARTICULARLY FOR MEASURING ANGULAR POSITION

BACKGROUND OF THE INVENTION

The present invention relates to a rotary potentiometer, particularly for measuring the angular position of a rotary element such as the throttle valve of an internal combustion engine.

Rotary potentiometers are known of the type having a stationary case provided on the inside with an electrical resistor defining a resistive track against which is applied a wiper carried by a rotor mounted in the case. The rotor is biased by a helical spring toward a rest position. The rest position is defined by a part of the rotor coming to rest against a stop portion of the case.

Rotation of the rotor causes the internal electrical resistance detected by the potentiometer to vary so that the ratio between the output and input voltages of the potentiometer is representative of the angle of rotation of the rotor in relation to its rest position. Measurement of this ratio can therefore be used in a potentiometric sensor to characterize the angular position of a rotary element in relation to a stationary point of reference.

In potentiometers of this type, during mounting of the rotor in the case, all contact must be avoided between the wiper and the resistive track to prevent damage thereto. This operation therefore is rather delicate and in the present state of the art requires an additional tool to be used to flatten the wiper against the rotor when the latter is being positioned in the case.

SUMMARY OF THE INvENTION

The object of the invention is to provide a potentiometer of type described above which is of a particularly simple design while making it possible to remedy the drawbacks of known potentiometers, particularly to avoid recourse to an additional tool for introduction of the wiper in the case.

For this purpose, the invention provides a rotary potentiometer having a stationary case containing a resistive track. An elastic wiper carried by a rotor mounted to rotate in the case and able, during operation, to rub against the resistive track, and a spring placed between the stationary case and rotor to pull the stop to a rest position. The case has a recess able to receive the wiper without initial stress or deformation in an initial position of introduction of the rotor in the case and to enable the wiper to come in contact with the track during mounting of the rotor in the case by rotation of said rotor between its introduction position and its rest position.

Moreover, known potentiometers of the type described above do not offer the possibility of obtaining with the same case and the same rotor a return of the rotor to its rest position either in the direct direction or indirect direction. When such a potentiometer is intended, for example, to measure the angular position of the throttle valve of an internal combustion engine, its use requires having a single direction of (direct) return of the rotor and throttle valve under the action of the respective return spring. In this case, the rotor is driven by the shaft of the throttle valve during an increase of the engine load and does not interfere with the return of the throttle valve to the "foot lifted" position. In the case of an opposite (indirect) return direction, the rotor would follow the throttle valve during a load increase but could block its return to the "foot lifted" position.

This possibility of failure justifies making two potentiometer versions meeting all possible while exhibiting a maximum of common parts for reasons of economy both in production and storage.

The invention makes it possible to achieve this aim by means of a potentiometer as defined above, in which the case and rotor have an axial plane of symmetry which permits their assembly selectively with either of two types of springs, one of which returns the rotor in the direct direction and the other in the indirect direction, and the rotor has two areas for fastening the wiper in one or the other of two positions symmetrical in relation to this plane, depending on the direction of return of the spring.

Finally, in known potentiometers of the type described above, the helical return spring generally has one of its fastening lugs parallel to the axis of the spring and the other in the plane of its coils. A hole in the potentiometer case receives the first lug, while the second lug is locked by a stop on the rotor. The drawback of this arrangement is that fastening of the spring in the case requires much dexterity and rules out an automatic mounting system.

According to the invention, this problem is solved thanks to the fact that the spring is a helical spring exhibiting, at its ends, locking lugs extending radially in the plane of the coils of the spring and one of which is able to engage in locking means made in the case and the other to rest against a first stop surface of the rotor.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein:

FIG. 2 is a view in section along line 2—2 of FIG. 3 of the potentiometer, shown during an intermediate phase of its assembly;

FIG. 3 is a view in section along line 3—3 of FIG. 2;

DETAILED DESCRIPTION OF THE PREFERRED EMBODIMENTS

Figure 1:
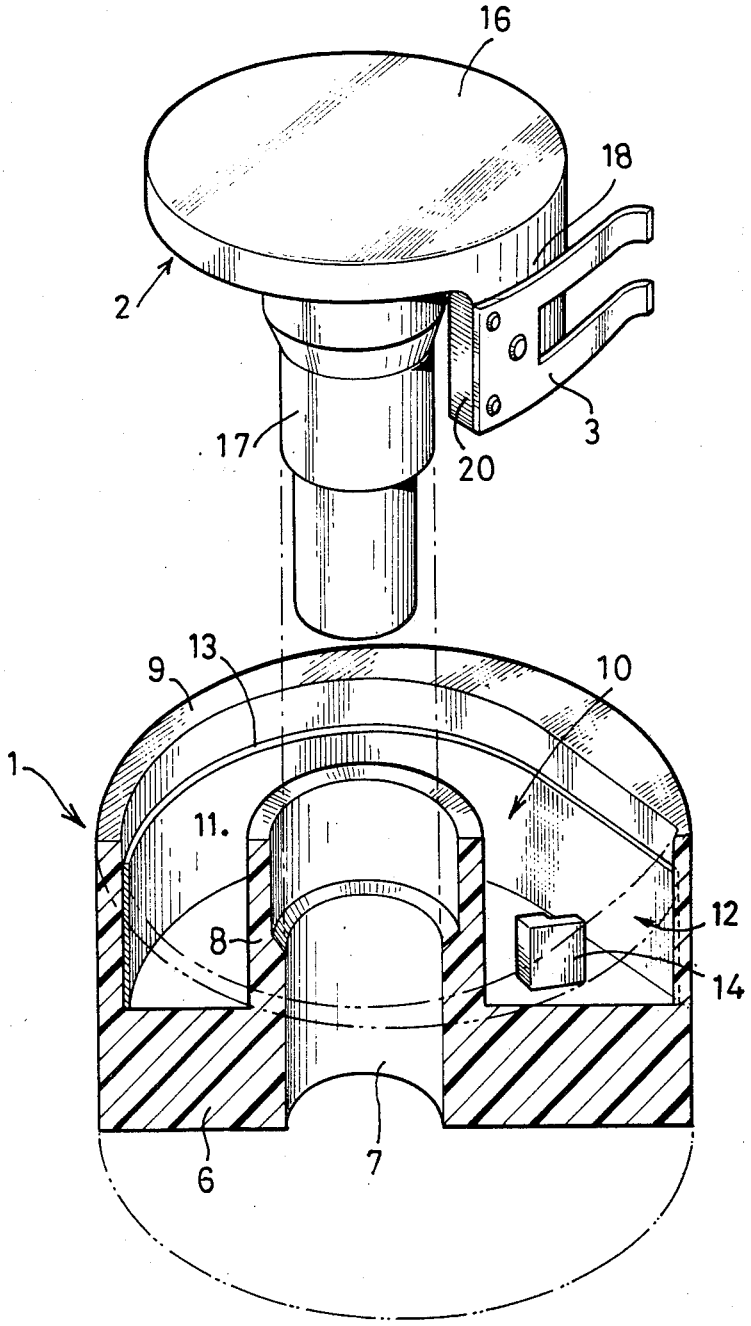
FIG. 1 is an exploded perspective view, with a partial cut-away, of the rotor and case of a potentiometer according to the invention.

Referring to FIGS. 1 to 5, the potentiometer shown has a case 1 in which a rotor 2 carrying an electrically conductive wiper 3 and an operating lever 4 is pulled to its rest position by a helical spring 5*a*.

Case 1 exhibits approximately the shape of cup and may be made of molded plastic. The cup bottom 6 is pierced with a hole 7. The hole 7 is also delimited by a tubular projection 8 extending upward from the bottom 6 of the cup. Tubular extension 8, of less height than peripheral wall 9 of the cup, delimits, with the wall 9 and the bottom 6, a cavity 10. The outside surface of tubular extension 8 is circular cylindrical while the inside surface of wall 9 defines a circular cylindrical part extended tangentially by two plane or slightly curved portions defining an approximately v-shaped section at one side, so that the cylindrical cavity 10 includes an annular area 11 having a circular peripheral wall of constant radius, connected to a second area forming a housing 12 with a v-shaped section.

The inside surface of wall 9 is covered, over a height approximately equal to that of tubular extension 8, with an electrical resistor defining an electrically resistive track 13 with which wiper 3 is in contact in the assembled position of the potentiometer. At its ends close to the bottom of housing 12, the track is connected to leads (not shown) for connection to a power supply.

Finally, two stops 14 and 15 project into housing 12 from bottom 6 of case 1. These stops, whose role will be explained below, are placed on both sides of a plane going through the axis of hole 7 and through the bottom of housing 12 between the ends of the track, and which constitutes a plane of symmetry for case 1, whose trace is shown by line 2—2 of FIG. 3.

Rotor 2 which, like case 1, exhibits an axial plane of symmetry and is preferably made of the same material as the case, has a head 16 from which a shaft 17 to be rotatably received in hole 7 forming a bearing surface, and a skirt portion 18 in the shape of a cylindrical sector, project in the same direction. Between them, shaft 17 and skirt portion 18 delimit an annular space in which tubular extension 8 and spring 5*a* penetrate in the assembled position of the potentiometer. Skirt portion 18 exhibits two end lateral edges 19 and 20 which act as stops, as explained below.

Wiper 3 is fastened on skirt portion 18 in the vicinity of edge 19 or edge 20, depending on whether one or the other versions of the potentiometer is involved, i.e., with return in the direct direction or in the indirect direction. Thanks to its symmetry in relation to an axial plane, the same wiper 3 can be used in both cases. Wiper 3 is connected to an output terminal by conventional means, not shown.

At its opposite ends, helical spring 5*a* exhibits locking lugs 21*a*, 22*a* extending radially from the axis of the coils of the spring.

Figure 6:
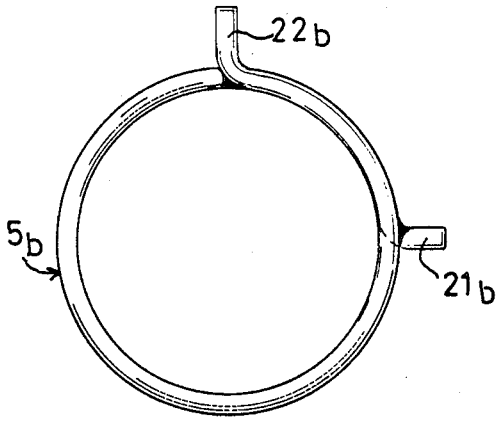
FIG. 6 is a plan view of a spring variant making possible the return of the rotor in the direction opposite to that of the embodiment of FIGS. 1 to 4A.

Spring 5*a*, of the embodiment of FIGS. 1 to 4A, is wound so as to exert its return force in the direct direction, while spring 5*b*, shown in FIG. 6 and intended to embody the other version of the potentiometer, exerts its return force in the indirect direction.

Finally, lever 4 (FIG. 5) also exhibits a longitudinal plane of symmetry so as to be able to be used equally with one or the other version of the potentiometer and can advantageously be made from stamped and folded sheet metal. At one of its ends lever 4 includes a suitable assembly means 24 making it possible to fix lever 4 to the free end of shaft 17 of rotor 2, and at its other end two curved lateral strips 23*a* and 23*b* placed symmetrically on both sides of a lengthwise strip 25 folded between the two lateral strips. This lever is intended to allow use of the potentiometer as a sensor of the angular position of a throttle valve whose control lever can come to rest against the convex outside surface of one or the other of lateral strips 23*a* and 23*b* depending on the version considered. Lengthwise strip 25 makes it possible to keep contact with the control lever from occurring between the lateral strips.

Mounting of the potentiometer with return in the direct direction corresponding to the embodiment of FIGS. 1 to 4A will now be described.

First, spring 5*a* is placed in case 1, around tubular extension 8, by engaging one of its locking lugs 21*a* between stops 14 and 15 (FIG. 3). Then rotor 2, equipped with a wiper 3 fastened on the suitable side of skirt portion 18, is presented so as to engage shaft 17 in hole 7. This operation is performed with the rotor 2 in an angular position relative to case 1 so that wiper 3 extends into housing 12 (FIG. 4); that is, the introduction position is that in which the planes of axial symmetry of case 1 and rotor 2 approximately coincide. The profile of housing 12, considered in crosswise section, is such that in this position it allows wiper 3 to penetrate freely therein without initial stress of the wiper and without contact by the wiper with track 13 which covers the inside surface of wall 9.

Figure 4:
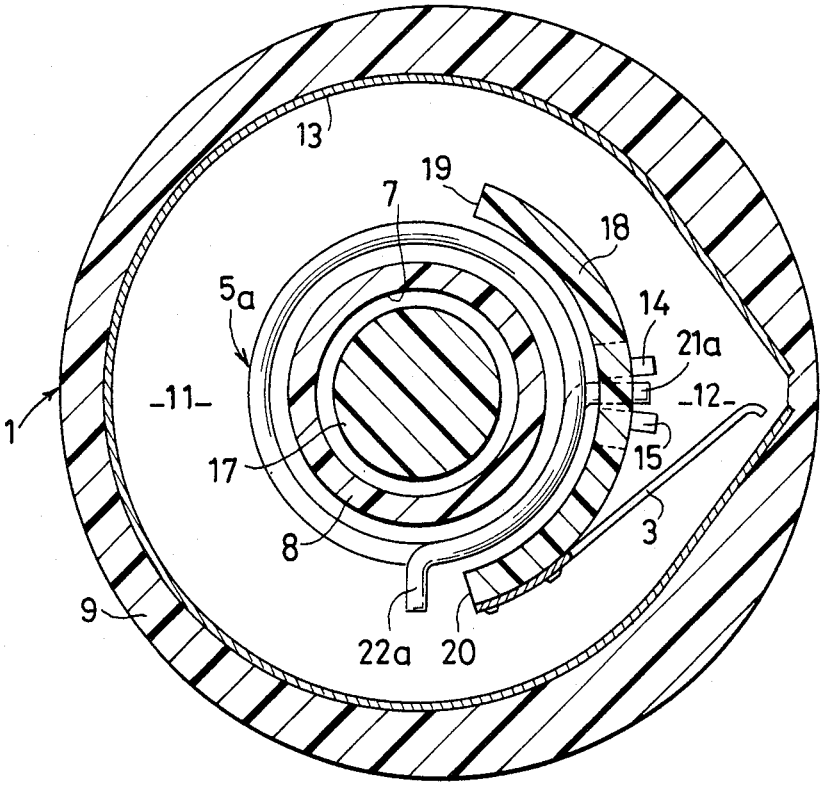
FIG. 4 is a view in section along line 4—4 of FIG. 2.
Figure 5:
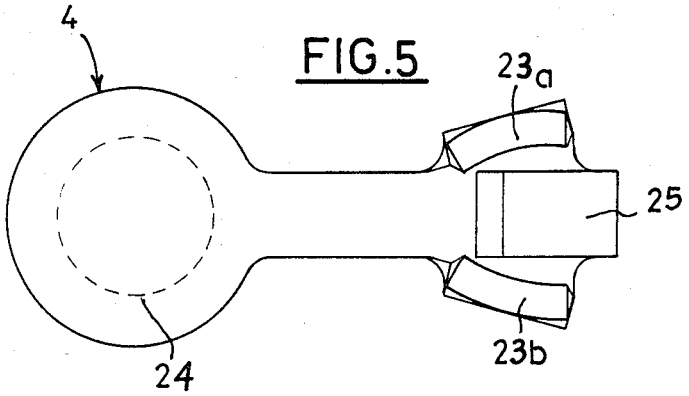
FIG. 5 is a bottom view of a rotor drive lever.

Rotor 2 can then be engaged more deeply in case 1 until the lower edge of skirt portion 18 comes to rest against the upper edge of stops 14 and 15, in the position shown in FIGS. 2 and 4.

Figure 4A:
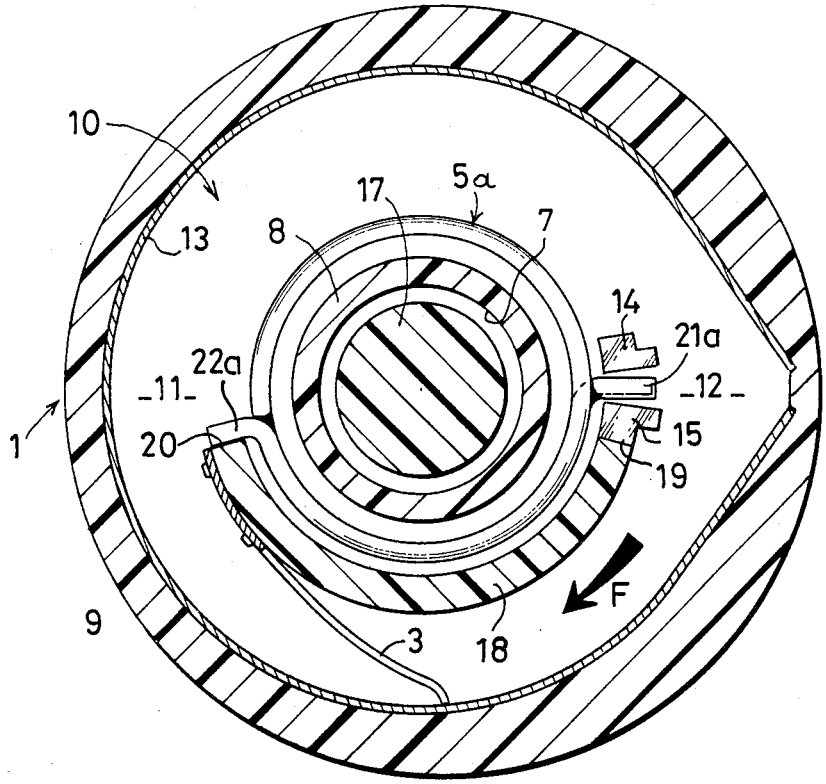
FIG. 4A is a view in section similar to FIG. 4 showing the potentiometer after final assembly.

Rotor 2 is then turned in the indirect direction shown by arrow F in FIG. 4A until lateral edge 20 of skirt portion 18 comes in contact with the other locking lug 22*a* of the spring, and then forces the latter in direction F while progressively applying an initial stress on spring 5*a*. During this rotation, the end of elastic wiper 3 moves from housing 12 to annular area 11 and is applied elastically against potentiometer track 13 in a friction mode similar to that of use. Said rotational movement of rotor 2 is continued until the moment when edge 19 of skirt portion 18 completely disengages stop 15. The rotor can then be pushed into case 1 until the lower edge of skirt portion 18 is in contact with the bottom of cavity 10, then released. Rotor 2 is then held in case 1 thanks to the initial stress of spring 5*a* which, by its lug 22*a* applied against lateral edge 20, pulls the other lateral edge 19 of skirt portion 18 against stop 15, which corresponds to the rest position of the potentiometer.

Assembly of the potentiometer can be completed by mounting of lever 4 on the end of shaft 17 which projects outside case 1 and by fastening of a cover (not shown) on the case to enclose rotor 2 and spring 5A therein.

For the embodiment of a potentiometer with a return in the indirect direction F, only fastening of wiper 3 on rotor 2 and the shape of the spring are different. Then, spring 5*b* is used which is symmetrical with spring 5A in relation to an axial plane going through one of the fastening lugs and wiper 3 is mounted on the rotor in a symmetrical position in relation to the axial plane of symmetry of the rotor, such as that shown, for example in Figure 4. The potentiometer therefore makes it possible to avoid the use of any additional tool for putting the wiper in place and assures the contact of the wiper with the potentiometer track at a favorable angle of attack, regardless of the version. Since the potentiometer wiper-track connection is particularly delicate, the potentiometer described associates simplicity and mounting quality, which can easily be automated.

Further, the two versions of the potentiometer, depending on the return direction of the rotor, can be made with common parts, with the exception of only the spring.

Of course, the invention is not limited to the embodiments described, and numerous modifications can be made to it without going outside its framework. Thus, for example, housing 12 could be made in the form of two distinct grooves symmetrical in relation to the plane of symmetry of the case, or the shape of the stops, of the skirt portion, etc., could be different, while performing the same role.

Finally, it will be noted that hole 7 and shaft 17 each have two areas of different diameter connected by a tapered shoulder and which assures guiding of shaft 17 of the rotor in case 1 along a double bearing at the areas of contact shown in FIG. 2.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A rotary potentiometer comprising:

a case;

a curved electrically resistive track fixed to said case, said track defining a cylindrical surface;

a rotor mountable in said case for rotation about an axis parallel to said track;

an elastic wiper carried by said rotor, said wiper including an end portion radially engageable, with respect to said axis, with a first circumferential portion of said track when said rotor is mounted in said case; and means for biasing said rotor into a rest angular position with respect to said axis in which said wiper end portion engages with said first circumferential portion, wherein said case is shaped such that said track defines a second circumferential portion with which said wiper end portion is not engageable during mounting of said rotor in said case, whereby said rotor is introduced along the direction of said axis into said case without engagement between said end portion and said second circumferential portion.

2. The potentiometer of claim 1 wherein said casing, said track and said rotor are symmetric about a plane containing said axis, and wherein said rotor has areas adapted for attachment of said wiper on two sides of said plane, whereby said means for biasing may be provided to bias said rotor in either of two rotational directions about said axis.

3. The potentiometer of claim 1 wherein said means for biasing comprise a coil spring positionable substantially coaxial with said axis, said spring having first and second ends, lugs extending radially of said axis, wherein said case includes locking means, wherein said rotor has a substantially axially extending first stop surface, wherein a circumferential position of said first end lug is fixable by engagement with said locking means, and wherein said second end lug is engagable with said first stop surface.

4. The potentiometer of claim 3 wherein said case has a shape of a cup defining a cavity, said cavity having a bottom extending substantially transverse to said axis, and a peripheral wall upon which said track is mounted, said bottom having a hole coaxial with said axis and a tubular extension extending into said cavity from said bottom and coaxial with said axis, said peripheral wall and track having a cylindrical circumferential portion with a constant radius centered on said axis and corresponding to said first circumferential portion of said track, said peripheral wall and track having a circumferential portion with a shape of a V in section, the apex of said V intersecting said plane and extending away from said axis, said V-shaped portion corresponding to said second circumferential portion of said track.

5. The potentiometer of claim 4 wherein said rotor includes:

a head;

a shaft extending from said head and positionable in said hole; and skirt means extending from said head in the direction of said shaft, said skirt means defining said first stop surface and a second stop surface engagable with said locking means when said second end lug engages said first stop surface.

6. The potentiometer of claim 5 wherein said skirt coaxially surrounds said shaft with an annular space therebetween, said spring and tubular extension extending into said annular space when said rotor is in said case.

7. The potentiometer of claim 1 including an operating lever having one end fixed to said rotor and extending out of said case, said lever having a longitudinal plane of positioned symmetry and a second folded end about which are symmetrical curved lateral support strips.

8. The potentiometer of claim 1 wherein said tubular extension is configured so as to rotatably support said shaft at two axially spaced positions.

9. The potentiometer of claim 2 wherein said means for biasing comprise a coil spring positionable substantially coaxial with said axis, said spring having first and second ends, lugs extending radially of said axis, wherein said case includes locking means, wherein said rotor has a substantially axially extending first stop surface, wherein a circumferential position of said first end lug is fixable by engagement with said locking means, and wherein said second end lug is engagable with said first stop surface.

10. The potentiometer of claim 9 wherein said case has a shape of a cup defining a cavity, said cavity having a bottom extending substantially transverse to said axis, and a peripheral wall upon which said track is mounted, said bottom having a hole coaxial with said axis and a tubular extension extending into said cavity from said bottom and coaxial with said axis, said peripheral wall and track having a cylindrical circumferential portion with a constant radius centered on said axis and corresponding to said first circumferential portion of said track, said peripheral wall and track having a circumferential portion with a shape of a V in section, the apex of said V intersecting said plane and extending away from said axis, said V-shaped portion corresponding to said second circumferential portion of said track.

11. The potentiometer of claim 10 wherein said rotor includes:

a head;

a shaft extending from said head and positionable in said hole; and skirt means extending from said head in the direction of said shaft, said skirt means defining said first stop surface and a second stop surface engagable with said locking means when said second end lug engages said first stop surface.

12. The potentiometer of claim 11 wherein said skirt coaxially surrounds said shaft with an annular space therebetween, said spring and tubular extension extending into said annular space when said rotor is in said case.

13. The potentiometer of claim 11 wherein said locking means comprises two stops extending from said bottom on either side of said plane.

* * * * *